United States Patent [19]

Husmann et al.

[11] Patent Number: 4,870,404

[45] Date of Patent: Sep. 26, 1989

[54] SENSOR DEVICE FOR PICKET BARRIER INTRUSION DETECTION AND LOCATION SYSTEM

[75] Inventors: Robert J. Husmann, Soquel; Claude A. S. Hamrick, Campbell, both of Calif.

[73] Assignee: Omni Signal, Inc., Capitola, Calif.

[21] Appl. No.: 212,844

[22] Filed: Jun. 29, 1988

Related U.S. Application Data

[63] Continuation of Ser. No. 82,010, Aug. 4, 1987, abandoned.

[51] Int. Cl.[4] ..... G08B 13/00

[52] U.S. Cl. ..... 340/550; 200/339

[58] Field of Search ..... 340/541, 550; 200/335, 200/339, 332

[56] References Cited

U.S. PATENT DOCUMENTS

| | | | |
|---|---|---|---|
| 4,155,083 | 5/1979 | Slaats et al. | 340/541 X |
| 4,683,356 | 7/1987 | Stoler | 340/541 X |
| 4,703,313 | 10/1987 | Husmann et al. | 340/550 |

*Primary Examiner*—Glenn R. Swann, III
*Assistant Examiner*—Thomas J. Mullen, Jr.
*Attorney, Agent, or Firm*—Rosenblum, Parish & Bacigalupi

[57] ABSTRACT

An alarm actuating sensor device for use in a picket barrier intrusion detection and location system including a generally t-shaped rocker element for rigid attachment to the upper end of a picket and for disposition within the upper longitudinally extending rail providing support for the picket, an elongated rocker spring pivotally engaged at its mid-point by a pin passed through the end of the picket and including downwardly turned end legs for engaging the lower wall of the rail and for exerting a biasing force on the picket pending to resist downward translation thereof, and a length of dual conductor "tape switch" the longitudinal axis of which extends generally along the longitudinal axis of the rail and passes between the rocker element and the rocker spring, whereby downward forces applied to the picket, or lateral forces tending to bend to the picket, cause the tape switch to be pinched between at least one extremity of the rocker spring and a portion of the rocker element thereby creating an electrical short at the pinch point which emulates the closing of a switch that can be sensed by suitable electrical or electronic apparatus coupled to the conductors forming the tape switch. A modified embodiment includes a lever arm pivotally attached to the rocker element and having one end connectable to a finial plate and a second end for pinching the tape switch in the event a finial is deflected.

12 Claims, 3 Drawing Sheets

FIG.4
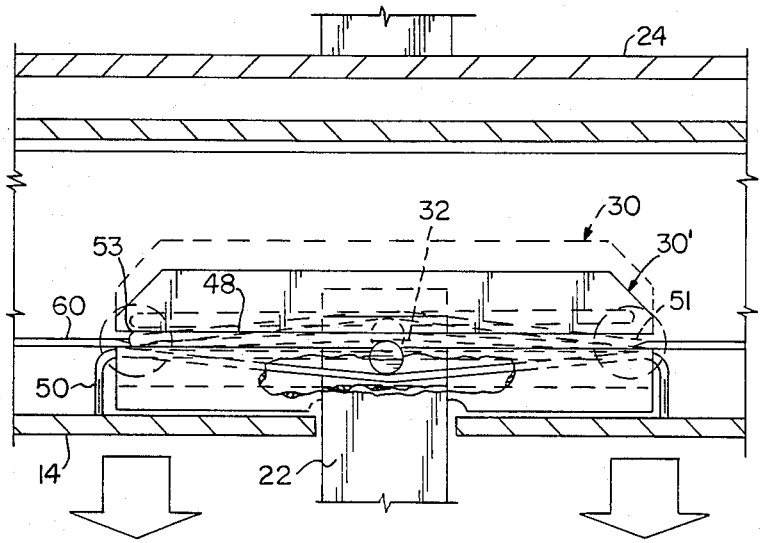
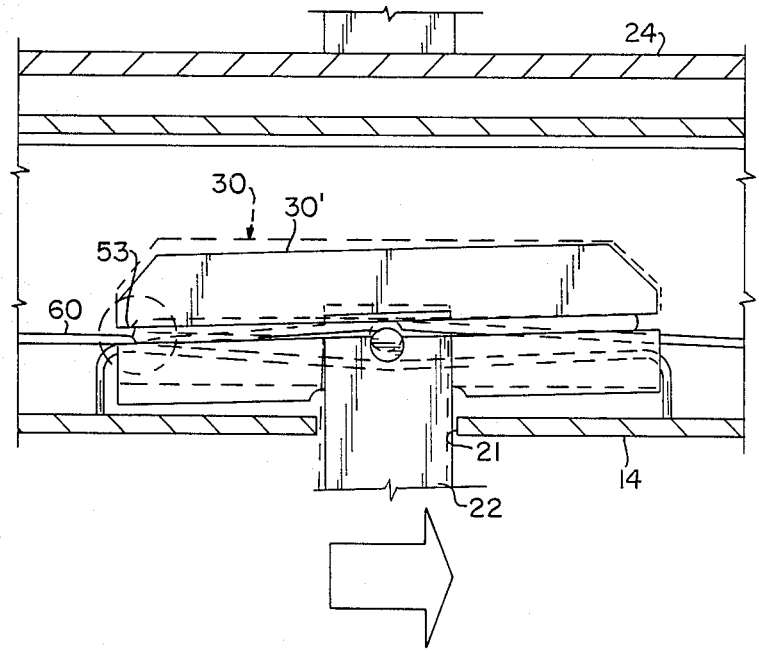
FIG.5

SENSOR DEVICE FOR PICKET BARRIER INTRUSION DETECTION AND LOCATION SYSTEM

This is a continuation of co-pending application Ser. No. 082,010 filed on Aug. 4, 1987 now abandoned.

BACKGROUND OF THE INVENTION

1. Field of the Invention

The present invention relates generally to motion detecting apparatus and more particularly to a novel sensing device to be contained within a longitudinally extending rail of a picket fence for attachment to one end of a picket in the fence for the purpose of detecting motion of the picket or associated finial in the event of an attempted intrusion.

This application is related to copending U.S. application Ser. No. 767,174 filed 08/19/85 and entitled "Picket Barrier and Intrusion Sensing System" and Ser. No. 034,410 filed Apr. 3, 1981 and entitled "Picket Barrier and Intrusion Sensing System" and U.S. application Ser. No. 82,029 filed Aug. 4, 1987 entitled "Alarm Locator Module for Picket Barrier Intrusion Detection and Location System", all of which are assigned to the assignee of the present invention.

DISCUSSION OF THE PRIOR ART

Prior art associated with the detection of intrusion through security fences and similar barriers is discussed in detail in the above referenced pending applications and the disclosure thereof is expressly incorporated herein by reference.

SUMMARY OF THE PRESENT INVENTION

A primary objective of the present invention to provide a motion sensing mechanism for attachment to one end of a picket in a picket fence to detect bending of the picket, and longitudinal translation of the picket.

Another object of the present invention is to provide a sensing mechanism of the type described which also detects bending deflection of finials associated with the pickets.

Another objective of the present invention is to provide a device of the type described which can be inexpensively fabricated from sheet metal, or made of suitable molded plastic materials, which can be easily assembled by unskilled labor.

Still another objective of the present invention is to provide a sensing device of the type described which although sensitive to the stated motions to be detected is not highly dimension critical in construction.

Yet another objective of the present invention is to provide a sensing device of the type described which when placed in a longitudinally extending picket holding rail is substantially unaffected by normal environmental elements and thus requires little if any maintenance over its useful lifetime.

Briefly, a preferred embodiment of the present invention includes a generally T-shaped rocker component adapted to be rigidly attached to the upper end of a picket and to be disposed within the upper longitudinally extending rail providing support for the picket, an elongated rocker spring component pivotally engaged at its mid-point by a pin passed through the end of the picket and including downwardly turned end legs adapted to engage the lower wall of the rail and to exert a biasing force on the picket tending to resist downward translation thereof, and a length of dual conductor "tape switch" (sometimes referred to as "ribbon switch") the longitudinal axis of which extends generally along the longitudinal axis of the rail and passes between the rocker component and the rocker spring, whereby downward forces applied to the picket, or lateral forces tending to bend the picket, cause the tape switch to be pinched between at least one extremity of the rocker spring and a portion of the rocker component, thereby creating an electrical short at the pinch point which emulates the closing of a switch that can be sensed by suitable electrical or electronic apparatus coupled to the conductors forming the tape switch. A modified embodiment includes a lever arm pivotally attached to the rocker member and having one end connectable to a finial plate and a second end for pinching the tape switch in the event a finial is deflected. In accordance with the present invention, one of the above-described sensing devices would be coupled to at least every other picket forming the picket barrier.

An important advantage of the present invention is that it is simple in structure and easy to install, either at a assembly point or in the field.

Another important advantage of the present invention is that it may be fabricated from relatively inexpensive materials using relatively inexpensive molding or forming techniques.

Still another advantage of the present invention is that it does not include any unsealed electrical contacts which would otherwise be subject to corrosion due to host of environmental elements.

These and other objects and advantages of the present invention will no doubt become apparent to those skilled in the art after having read the following detailed disclosure of the preferred embodiments which are illustrated in the several figures of the drawing.

IN THE DRAWING

FIGS. 4 and 5 are broken sectional views taken generally along the line 4—4 of FIG. 2 and illustrate operation of the preferred embodiment.

DETAILED DESCRIPTION OF THE PREFERRED EMBODIMENTS

Figure 1:
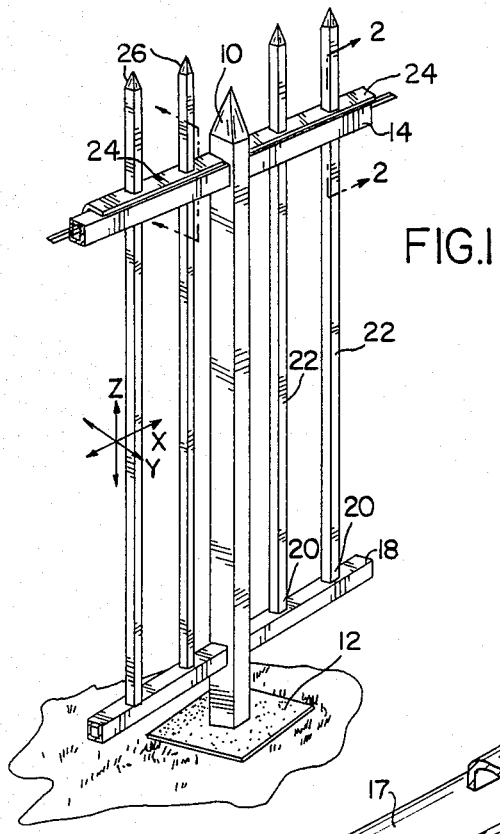
FIG. 1 is a partially broken perspective view illustrating a portion of a picket fence of the type in which the present invention might be utilized.

Referring now to FIG. 1 of the drawing, a portion of a picket fence or barrier is shown including a post 10 that typically is fabricated of steel and embodied in a concrete base 12. Attached to and extending between post 10 and similar additional posts typically spaced along the fence line at 8 to 10 foot integrals are horizontal steel rails 14 and 18 typically formed of a steel channel having a C-shaped transverse cross section. Extending into openings 20 formed in the upper surface of lower rail 18 and similar openings 16 (not shown in FIG. 1) formed in the lower surface of the upper rail 14 are pickets 22 made of either solid rods or hollow steel tubes of square or rectangular cross section.

In accordance with the present invention, and as will be more fully disclosed below, the pickets 22 are not rigidly affixed to the rails 14 and 18 and are free to move upwardly or downwardly a short distance. Affixed to the top surface of the top rail 14 by means of suitable lugs or pins, also described below, are finial support plates 24 to which a plurality of upwardly extending finials 26 are rigidly affixed.

For purposes of the following discussion, lateral translation or deflection of the pickets 22 is intended to mean motion directed generally in the X-Y plane, while axial translation or up and down motion of the pickets will mean motion generally along the Z axis. Finial motion will generally be considered to be rotation about the longitudinal axis of the upper rail 14 and in a direction to one side or the other of the fence.

Figure 2:
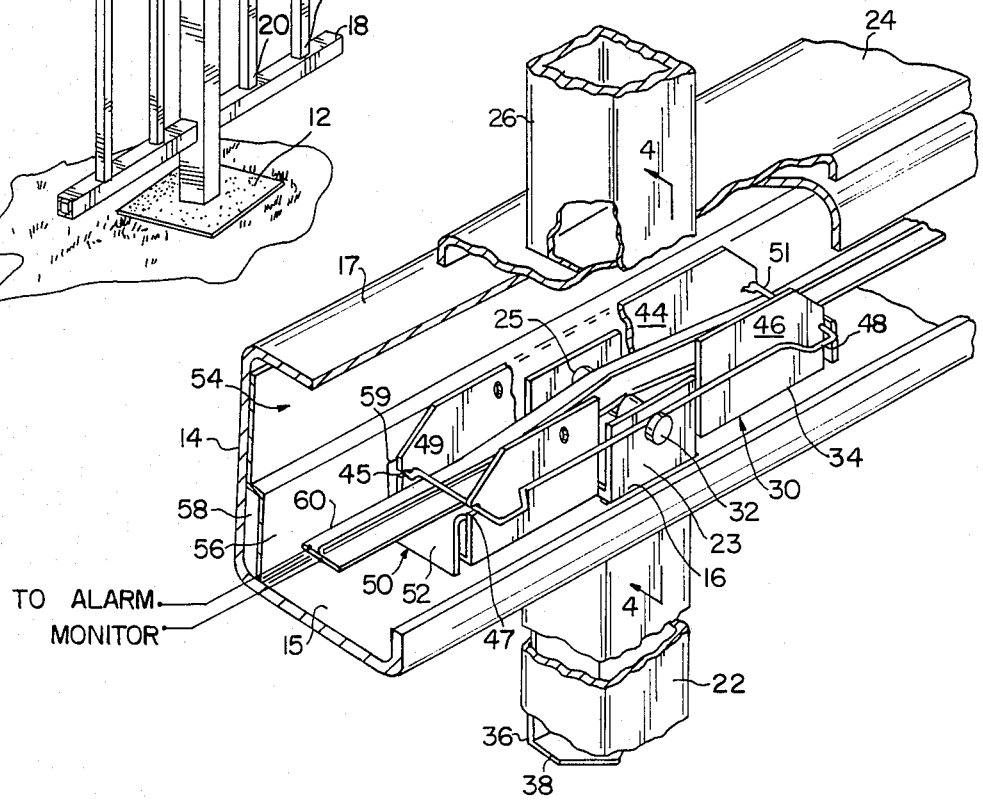
FIG. 2 is a partially broken perspective view taken generally along the line 2—2 of FIG. 1 and showing the principal operative components of a preferred embodiment of the present invention.
Figure 3:
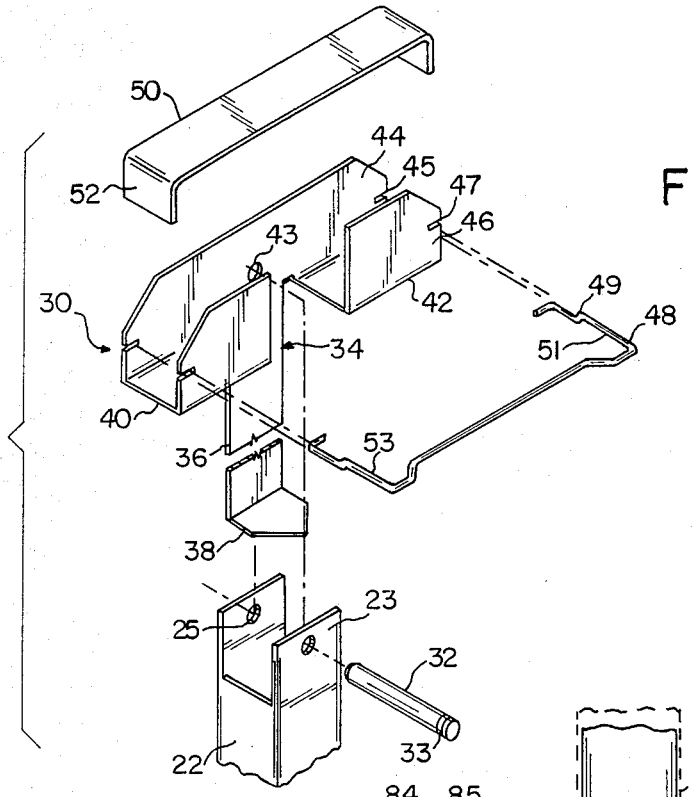
FIG. 3 is an exploded perspective view showing the several components of the preferred embodiment illustrated in FIG. 2.

Turning now to FIG. 2 of the drawing, which is a partially broken perspective view taken generally along the line 2—2 of FIG. 1, showing an assembled sensing device 30 in accordance with the present invention in place in the rail 14, and FIG. 3 which is an exploded view of the sensing device 30 showing its component parts, as indicated, the upper end of picket 22 extends through the opening 16 in the bottom of rail 14 and terminates in upstanding side tabs 23 having openings 25 formed therein for receiving a pin 32. Disposed between tabs 23 is a T-shaped rocker member 34, more clearly depicted in the exploded view of the FIG. 3, including a downwardly projecting portion 36 having a forwardly extending tab 38 at its distal end, and laterally extending arms 40 and 42 at its upper end formed to have upstanding side portions 44 and 46 provided with notches 45 and 47 respectively, which are adapted to receive a spring clip 48. Note that the notches 45 are positioned slightly lower than the notches 47 so as to accommodate the downward offset 49 in each end of the clip 48. An aperture 43 is also centrally positioned in the upstanding side 44 for receiving one end of the pin 32.

Shown in its assembled position in FIG. 2 and exploded into position above the rocker 40 in FIG. 3 is a rocker spring 50 having down turned ends 52 which rest upon the lower inside surface 15 of rail 14.

Assembly of the sensor 30 is accomplished by first inserting the leg 36 of member 40 through the opening 16 in rail 14 and into the upper end of picket 22 as the picket and is inserted into the opening 16. The rocker spring 50 is then positioned as indicated between the sides 44 and 46 and the pin 32 is inserted through the openings 25 in picket tabs 23 and the opening 43 (FIG. 3) in rocker arm sidewall 44. Note that pin 32 passes over the top of rocker spring 50. The tape switch 60 is then laid between the walls 44 and 46, and over the top of pin 32 and the ends of rocker spring 50. To complete the assembly of sensor 30, spring clip 48 is inserted into the notches 45 and 47 and over the top of tape switch 60. At the same time, the center of spring 48 is raised slightly to clear the end of pin 32 and is then allowed to spring downwardly into engagement with the annular groove 33 formed in the end of pin 32 thereby locking pin 32 in place.

In FIG. 2 a side plate 54 is also shown which has an offset bottom half 56 that forms a passagway 58 for additional conductors. Plate 54 also has a plurality of rectangular openings 59 (see also FIG. 6) which receives an end of pin 32 and the ends of clip 48. The upper edge of openings 59 are positioned slightly above the rest position of the clip ends and interfere therewith to limit the upward travel of pickets 22.

Turning now to FIGS. 4 and 5, operation of the sensor 30 will be illustrated and described in detail. As depicted by the dashed lines, the sensor 30 and picket 22 is normally biased into its rest position by the engagement of pin 32 and rocker spring 50. Rocker spring 50, beneath ends of spring clip 48 and over pin 32. However, when a downward force is applied to picket 22 it will be appreciated that, as illustrated, downward motion of picket 22 will cause a resilient deformation of rocker spring 50, and because of the coupling of rocker 30 to picket 22 by pin 32, rocker 30 will likewise be pulled downwardly. As this occurs, the ends 51 and 53 of clip 48 will engage tape switch 60 and pinch it between the upper surface of each end of rocker spring 50 as shown in the encircled portions of the drawing. Either one or both of these pinching contacts will cause a short in the tape switch 60 which will be detected by remote detection means (typically an alarm monitoring system) coupled thereto. In the event the downward force is then removed from picket 22, the picket and rocker will be returned to their rest position by rocker spring 50 and the pinching action will be abated, and the short will open due to the resilient characteristics of the tape switch.

In FIG. 5 a similar result is depicted in response to a bending force applied to the picket 22. However, in this case, only the spring clip end 53 will pinchingly engage tape switch 60 and signal an alarm condition. Note that the pivoting action takes place as the rocker 30 and picket 22 rotate as a unit about the right edge of rail opening 21.

Figure 6:
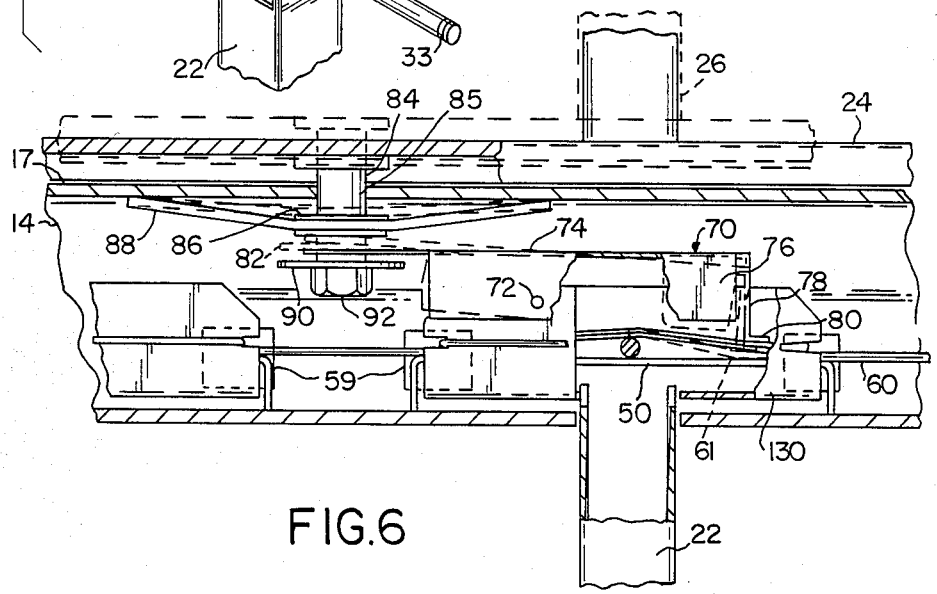
FIG. 6 is a partially broken cross sectional view taken generally along the line 6—6 of FIG. 1 and depiciting a modified sensing device adapted to additionally detect motion of the fence finials.

Turning now to FIG. 6 of the drawing, a modified version of sensor 30 is shown at 130. This embodiment is modified to include an upper lever element 70 which is pivotally secured to the side walls of rocker 130 by pivot pin 72. Element 70 in the illustrated embodiment is fabricated from sheet metal and includes an elongated upper lever forming portion 74 and down turned side portions 76 forming stiffening members having apertures formed therein for receiving the pin 72. A downwardly turned leg 78 terminates in a tape switch engaging foot 80. The left most end 82 of lever portion 74 forms a fork like member extending on each side of a stud 84 which rigidly attached to the bottom surface of the finial supporting member 24.

Stud 84 is provided with means forming a pair of shoulder flanges 86 for engaging a resilient spring member 88. A flat washer 90 is secured to the lower end of stud 84 by a bolt 92.

In operation, spring 88 normally maintains finial support member 24 in firm contact with the upper surface 17 of rail 14. However, in the event that a force transverse to the longitudinal axis of rail 14 is applied to any finial 26, it will cause the member 24 to rotate upwardly about an edge thereof, and in so doing pull stud 84 upwardly through the opening 85 and against the force of spring 88. Such upward movement will cause washer 90 to engage the fork end 82 of lever 74 and cause the lever member 70 to rotate clockwise about pin 72 causing the foot 80 to clampingly engage tape switch 60 and cause a short therein as illustrated by the dashed lines at 61. By selecting the characteristics of spring 88, it will be appreciated that the minimum force applied to finial 26 which will cause the alarm actuating engagement of foot 80 and tape switch 60 can be predetermined. In accordance with the preferred embodiment, such a force might fall within the range of 30 to 60 pounds of force applied to the distal end of any finial 26.

Similarly, the spring characteristics of rocker spring 50 can be selected so that a downward force in excess of some predetermined amount must be applied to picket 22 before the wire portions 51 and 53 (FIG. 2) are caused to engage tape switch 60.

In the preferred embodiment, at least one of the modified sensors 130 shown in FIG. 6 would normally be incorporated into each segment of rail 14 so as to detect any lateral forces applied to the finials 26 along that segment of fence. If a single sensor 130 is utilized, it would normally be placed at a mid-point along the length of the rail 14. If two or more sensors 130 are utilized in each rail segment, they would typically be positioned at equal intervals along the length of the rail segment.

It will thus be appreciated that in accordance with the present invention a means is provided which will signal the application of a bending force causing at least a predetermined deformation of any picket 22, or a vertical translation of any picket 22 in response to a predetermined downward force, or a lateral deflection of any finial 26 in response to a predetermined force applied thereto.

Although the illustrated preferred embodiments are described as being made of sheet metal deformed to form various operative elements, it will be appreciated that any or all of the parts could alternatively be formed in other functionally corresponding configurations and could also be molded from suitable plastics or other materials. Note that as configured in the drawing the assembly of the several components can be accomplished through the open side of rail 14 prior to the insulation of a suitable closure plate.

Although the present invention has been illustrated above in terms of particular embodiments, it will be understood that numerous alterations and modifications will become apparent to those skilled in the art. Accordingly, it is intended that the appended claims be interpreted to included all such alterations and modifications as fall within the scope of the claims.

We claim:

1. A sensor device for disposition in a horizontally extending rail of a picket fence having a plurality of vertically disposed pickets, comprising:

an elongated rocker element adapted to have its mid-point rigidly attached to the upper end of a picket passing through an aperture in the bottom of said rail;

an elongated rocker spring associated with said rocker element and tending to bias said rocker element and said picket into a rest position;

a length of tape switch including first and second spaced apart conductors extending over the top of said rocker spring; and clip means affixed to said rocker element and lying over said tape switch, whereby a force applied to said picket moving any part of said rocker element downwardly will cause said clip means to pinch said tape switch against said rocker spring and cause shorting contact therein.

2. A sensor device as recited in claim 1 and further comprising:

a lever means pivotally affixed to said rocker arm and having one end coupled to finials disposed above said rail and an opposite end disposed above and proximate said tape switch, whereby deflection of said finials will cause said lever means to rotate and pinchingly engage said tape switch and cause a short therein.

3. An alarm actuating sensor means for disposition in a horizontally extending rail of a picket fence including a plurality of elongated vertically disposed pickets, comprising:

a length of deformable, signal conducting material for connection to an alarm device and operable when deformed to develop a deformation responsive signal for communication to said alarm device;

a rocker element for attachment to an end of a picket and including means for deformably engaging said signal conducting material when said picket is axially translated or laterally deflected; and spring means for biasing said rocker element into a rest position normally out of deforming engagement with said signal conducting material, whereby when a force is applied to said picket causing at least a predetermined axial translation or lateral deflection thereof, said rocker element is moved from said rest position into actuating engagement with said signal conducting material causing deformation thereof which in turn causes a responsive signal to be communicated to said alarm device.

4. An alarm actuating sensor means as recited in claim 3 wherein said signal conducting material is a tape switch including a pair of metallic conductors extending parallel to each other in spaced apart relationship and enveloped in an insulating resilient material which normally maintains said conductors out of contact with each other, but when deformed allows said conductors to ohmically contact each other.

5. An alarm actuating sensor means as recited in claim 3 wherein said spring means has a portion disposed on one side of said signal conducting material, and said means for deforming is disposed on the opposite side of said material such that when said rocker element is moved from said rest position, said signal conducting material is deformed against said portion of said spring means.

6. An alarm actuating sensor means as recited in claim 3 wherein said rocker element is generally T-shaped and includes a vertically extending leg adapted to engage the end of said picket, and two laterally extending arms having distal extremities forming said means for deformably engaging said signal conducting material.

7. An alarm actuating sensor means as recited in claim 6 wherein said spring means includes an elongated spring member having down-turned ends, the distal portions of which rest upon an interior surface of said rail, and a mid-portion which is engaged by said rocker element.

8. An alarm actuating sensor means as recited in claim 3 and further comprising:

an elongated lever means coupled to a finial disposed above said rail, said lever means being affixed to said rocker element and operative to cause deformation of said signal conducting material when said finial is deflected more than a predetermined amount from a rest position.

9. An alarm actuating sensor means as recited in claim 4 wherein said spring means has a portion disposed on one side of said signal conducting material, and said means for deforming is disposed on the opposite side of said material such that when said rocker element is moved from said rest position, said signal conducting material is deformed against said portion of said spring means.

10. An alarm actuating sensor means as recited in claim 9 wherein said rocker element is generally T-shaped and includes a vertically extending leg adapted to engage the end of said picket, and two laterally extending arms having distal extremities forming said means for deformably engaging said signal conducting material.

11. An alarm actuating sensor means as recited in claim 10 and further comprising:

an elongated lever means coupled to a finial disposed above said rail, said lever means being affixed to said rocker element and operative to cause deformation of said signal conducting material when said finial is deflected more than a predetermined amount from a rest position.

12. An alarm actuating sensor means as recited in claim 7 and further comprising:

an elongated lever means coupled to a finial disposed above said rail, said lever means being affixed to said rocker element and operative to cause deformation of said signal conducting material when said finial is deflected more than a predetermined amount from a rest position.

* * * * *